US005958547A

United States Patent [19]

Fukunishi et al.

[11] Patent Number: 5,958,547

[45] **Date of Patent: *Sep. 28, 1999**

[54] INTERIOR BASE MATERIAL

[75] Inventors: Akira Fukunishi, Shiga-ken; Yukio Zenitani, Nara-ken, both of Japan

[73] Assignee: Sanyo Chemical Industries, Ltd., Kyoto, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/521,144

[22] Filed: Aug. 29, 1995

[30] Foreign Application Priority Data

Sep. 14, 1994 [JP] Japan ..... 6-247312

[51] Int. Cl.[6] ..... D03D 27/00

[52] U.S. Cl. ..... 428/87; 428/195; 428/327; 428/474.4; 428/500; 428/520; 428/521; 442/59

[58] Field of Search ..... 428/327, 195, 428/532, 87, 474.7, 500, 520, 521; 442/59

[56] References Cited

U.S. PATENT DOCUMENTS

| | | | |
|---|---|---|---|
| 4,166,044 | 8/1979 | Germonprez et al. | 252/408 |
| 4,188,437 | 2/1980 | Rohowetz | 428/199 |
| 4,471,079 | 9/1984 | Enami | 523/161 |
| 4,517,244 | 5/1985 | Kobayashi et al. . | |
| 4,650,714 | 3/1987 | Kojima et al. . | |
| 4,702,742 | 10/1987 | Iwata et al. | 8/495 |
| 4,849,770 | 7/1989 | Koike et al. | 346/1.1 |
| 4,877,680 | 10/1989 | Sakaki et al. | 428/332 |
| 5,338,597 | 8/1994 | Kurabayashi et al. . | |
| 5,631,071 | 5/1997 | Fukunishi et al. . | |

FOREIGN PATENT DOCUMENTS

| | | |
|---|---|---|
| 0 568 955 A1 | 11/1993 | European Pat. Off. . |
| 2 318 881 | 2/1977 | France . |
| A-60-046290 | 3/1985 | Japan . |
| A-5-148777 | 6/1993 | Japan . |
| A-5-179577 | 7/1993 | Japan . |

OTHER PUBLICATIONS

Database WPI Week 8517, Derwent Publications Ltd., London, GB; AN 85–101549 & JP–A–60 046 290 (Teijin KK), Abstract.

Database WPI Week 9333, Derwent Publications Ltd., London, GB; AN 93–262179 & JP–A–05 179 577 (Sanyo Chem Ind Ltd), Abstract.

European Search Report dated Nov. 11, 1993 (Application No. 93110102.6).

EPO Office Action dated May 29, 1995 (Application No. 93110102.6–2113).

*Primary Examiner*—Pamela R. Schwartz
*Attorney, Agent, or Firm*—Merchant & Gould P.C.

[57] ABSTRACT

An interior base material is obtained by a method comprising a step of treating with a treating agent which comprises (A) a water-insoluble water-absorbent resin having a water absorbency to pure water for 50 to 1,000 ml/g and a particle size of 0.1 to 100 $\mu$m, (B) a polyoxyalkylene nonionic surfactant and/or an anionic surfactant, and (C) a solvent having the boiling point of 50 to 250° C. A process for printing the thus-treated interior base material comprises applying a dye ink having a viscosity of 1 to 100 cps by an ink-jet method, or applying a textile printing dye paste having a viscosity of 100 to 10,000 cps by a textile printing method followed by a heat-color developing treatment. The present invention provides a printed object with excellent sharpness, penetration effect enabling uniform printing from the surface to the deep part of the base material even to a base material having a thick three-dimentional structure or a base material having a long pile and thickness such as moquette, with an excellent build-up.

14 Claims, No Drawings

INTERIOR BASE MATERIAL

BACKGROUND OF THE INVENTION

1. Field of the Invention

This invention relates to interior base materials and processes of printing the interior base materials by an ink-jet method or a textile printing method, more specifically, interior base materials having a three-dimensional structure and a considerable thickness on which a sharply-outlined pattern is printed by means of homogeneously penetrating a dye ink or a textile printing dye paste by an ink-jet method or a textile printing method to the deep part of the base material, and the printing process thereof.

2. Description of the Prior Art

A conventional interior base material printing is conducted by an ink-jet printing method or a textile printing method. In other words, a printed object having a sharp printed image is achieved by printing a dye ink or a textile printing dye paste having an appropriate viscosity onto an interior base material such as fabric, carpet substrate and paper. It is proposed as another method of obtaining a printed fabric by treating a fabric with an aqueous dispersion of a water-absorbent resin to have the water-absorbent resin adhere to the fabric, followed by printing with an ink-jet printing method as disclosed in the Japanese Patent Application Laid Open No. 148777/1993.

Although such conventional methods are effective in obtaining a printed image pattern having a sharp outline on the surface of an interior base material having a flat plane, they cannot provide a valuable printing thoroughly penetrated from the surface to the deep part when a base material having a three-dimensional structure with a considerable thickness, such as a base material having an unevenness or a base material having a long staple including moquette is used, since it is difficult to penetrate a dyeing ink or a textile printing dye paste to the deep part.

SUMMARY OF THE INVENTION

It is one object of the invention to provide an interior base material which allows a valuable printing thoroughly penetrated from the surface to the deep part, even when the material has a three-dimensional structure with a considerable thickness such as a base material having an unevenness or a base material having a long pile including moquette.

It is another object of the invention to provide a process of printing an interior base material which allows a valuable printing thoroughly penetrated from the surface to the deep part even when the material has a three-dimensional structure with a considerable thickness, such as a base material having an unevenness or a base material having a long pile including moquette.

The present invention relates to an interior base material which is treated with a treating agent comprising (A) a water-insoluble water-absorbent resin having a water-absorption ability for pure water of 50 to 1,000 ml/g and a particle size of 0.1 to 100 μm, (B) a polyoxyalkylene nonionic surfactant and/or an anionic surfactant and (C) a solvent having a boiling point of 50 to 250° C.

Further, the present invention relates to a process for printing an interior base material by applying a dyeing ink having a viscosity of 1 to 100 cps by an ink-jet method followed by a heat-color developing treatment to an interior base material which is treated with a treating agent comprising (A) a water-insoluble water-absorbent resin having a water absorbency for pure water of 50 to 1,000 ml/g and a particle size of 0.1 to 100 μm, (B) a polyoxyalkylene nonionic surfactant and/or an anionic surfactant and (C) a solvent having a boiling point of 50 to 250° C.

Still further, the present invention relates to a process for printing an interior base material by applying a textile printing dye paste having a viscosity of 100 to 10,000 cps by a textile printing method followed by a heat-color developing treatment to an interior base material which is treated with a treating agent comprising (A) a water-insoluble water-absorbent resin having a water absorbency for pure water of 50 to 1,000 ml/g and a particle size of 0.1 to 100 μm, (B) a polyoxyalkylene nonionic surfactant and/or an anionic surfactant and (C) a solvent having a boiling point of 50 to 250° C.

DETAILED DESCRIPTION OF THE PREFERRED EMBODIMENT

Examples of the (A) water-insoluble water-absorbent resins used in the present invention include ① a water-insoluble water-absorbent resin obtainable by polymerizing starch or cellulose (a), a monomer selected from the group consisting of a water-soluble monomer having a carboxyl group or a sulfonic acid group and a monomer capable of becoming water-soluble by hydrolysis (hereinafter designated as a water-soluble monomer) (b) and a crosslinking agent (c) as the essential components and subsequently carrying out, if necessary, hydrolysis (hereinafter designated as a starch or cellulose derived crosslinking polymer).

Details of the components (a), (b) and (c) used in producing the water-insoluble water-absorbent resins mentioned above and the proportions of the components (a), (b) and (c), production methods and specific examples of the water-insoluble water-absorbent resins are disclosed in the Japanese Patent Application Laid Open No. 25886/1977 and the Japanese Patent Publication No. 46199/1978, No. 46200/1978 and No. 21041/1980.

Examples of (a) include raw starches such as sweet potato starch, potato starch, wheat starch, corn starch, rice starch, and tapioca starch; processed starches such as oxidized starch, dialdehyde starch, alkyl etherized starch, oxyalkylated starch, amino ethyl etherized starch and cyano ethyl-etherized starch; and celluloses such as natural cellulose, carboxymethyl cellulose, and cellulose ether.

Examples of (b) include monomers having a carboxyl group such as (meth)acrylic acid and maleic anhydride; monomers having a carboxylate group such as sodium (meth)acrylate, sodium maleate, trimethylamine salt of (meth)acrylic acid and trimethanolamine salt of (meth) acrylic acid; monomers having a sulfonic acid group such as vinyl sulfonic acid, vinyl toluene sulfonic acid and sulfopropyl (meth)acrylate: and monomers having a sulfonate group such as sodium vinyl sulfonate, methyl amine salt of vinyl sulfonic acid and sulfopropyl diethanol amine salt of (meth)acrylic acid.

Examples of (c) include polyols such as ethylene glycol trimethylol propane, bisacrylamides such as N,N-methylene-bisacrylamide; multifunctional (meth)acrylates such as ethylene glycol di(meth)acrylate, polyethylene glycol di(meth)acrylate and trimethylol propane tri(meth) acrylate; methylol (meth)acrylamide and glioxal.

In the description herein, "(meth)acrylic-" denotes "acrylic-" or "methacrylic-".

Other examples of the (A) water-insoluble water-absorbent resins include ② resins obtained by polymerizing the components (a) and (b), such as hydrolyzed products of starch-acrylonitrile graft polymer and hydrolyzed products of cellulose-acrylonitrile graft polymer (hereinafter designated as a starch- or cellulose-acrylonitrile graft polymer); ③ crosslinked material of (a), such as crosslinked carboxy methyl cellulose; ④ a copolymer of the components (b) and (c) such as partially hydrolyzed products of crosslinked polyacrylamide, crosslinked copolymers of acrylic acid-acrylamide, crosslinked sulfonated polystyrene, saponified copolymers of vinylester-unsaturated carboxylic acid disclosed in the Japanese Patent Application Laid Open No. 14689/1977 and No. 27455/1977, salts of crosslinked polyacrylic acid, crosslinked copolymers of acrylic acid-acrylic ester, crosslinked copolymers of isobutylene-maleic acid anhydride and crosslinked carboxylic acid modified polyvinyl alcohol; and ⑤ self-crosslinking polymerization products of the component (b) such as self-crosslinkable polyacrylic acid salts. These water-insoluble water-absorbent resins may be used alone or in combination of two or more.

Among the above examples, water-insoluble water-absorbent resins of ① and some of ④ such as the partially hydrolyzed products of crosslinked polyacrylamide, crosslinked copolymers of acrylic acid-acrylamide, crosslinked polyacrylic acid salts (examples of the salts include the alkali metal salts and ammonium salts), crosslinked copolymers of acrylic acid-acrylic acid ester, crosslinked copolymers of isobutylene-maleic acid anhydride and crosslinked carboxylic acid modified polyvinyl alcohol, are preferable.

The water absorbency of the (A) water-insoluble water-absorbent resins for pure water is 50 to 1,000 ml/g, preferably 100 to 1,000 ml/g. If the water absorbency for pure water of the water-insoluble water-absorbent resins is less than 50 ml/g, the blurring prevention effect deteriorates in an ink-jet method or a textile printing method with a dye ink or a textile printing dye paste. On the other hand, if the water absorbency for pure water of the water-insoluble water-absorbent resins is more than 1,000 ml/g, the blurring prevention effect has already reached equilibrium and thus does not become greater. The shape of the (A) water-insoluble water-absorbent resin is not particularly limited, but a fine powdery shape with a particle size of 0.1 to 100 μm is preferable, in particular, one with a particle size of 0.1 to 70 μm is more preferable. It is preferable to have a particle size of 0.1 to 100 μm to have a sharp printed image without risks of problems such as: if the particle size is too small, particles become too close to each other on the interior base material to deteriorate the blurring prevention effect of the dye ink or the textile printing dye paste, or if the particle size is too large, outline of the printed picture becomes less sharp.

According to the invention, (B) is selected from polyoxyalkylene nonionic surfactants (B1) and/or anionic surfactants (B2). Examples of (B1) and (B2) include the surfactants disclosed in the Japanese Patent Application Laid Open No. 240012/1990, No. 135432/1991, P. 258 to 675 of "New Surfactants" written by Hiroshi Horiguchi published by Sankyo Shuppan on Oct. 10, 1975, and P. 116 to 122 of "Fats and Oils Surfactants and the Related materials as Existent Chemical Substances" compiled by the Japan Soap and Detergent Industrial Association and the Japan Surfactant Industrial Association in December 1974. And any of these surfactants disclosed can be used.

Concrete examples of such polyoxyalkylene nonionic surfactants (B1) include the following surfactants classified in (B1-1) to (B1-5) as follows. Numerals in parentheses illustrate the molar number of addition of alkylene oxide.

Polyoxyalkylene alkyl ether nonionic surfactants (B1-1) include polyoxyalkylene ethers of an alcohol (an alcohol herein denotes a natural and/or synthetic alcohol having a carbon number of 8 to 30 with a straight chain or a branched structure) such as polyoxyethylene (7) lauryl ether, polyoxyethylene (10) oxypropylene (1) oleyl ether, polyoxyethylene (5) octyl ether, polyoxyethylene (10) oxypropylene (1) oleyl ether.

Polyoxyalkylene aryl ether nonionic surfactants (B1-2) include alkylene oxide adducts of phenols [phenols herein denote monocyclic phenols (phenols substituted by one or a plurality of an alkyl group), polyhydric phenols, and polycyclic phenols (such as phenylphenol, cumylphenol, benzylphenol, hydroquinone monophenyl ether, naphthol)] such as polyoxyethylene (7) nonylphenyl ether, polyoxyethylene (10) oxypropylene (2) heptacumylphenyl ether, polyoxyethylene (10) nonylphenyl ether, polyoxypropylene (2) oxyethylene (12) nonylphenyl ether.

Polyoxyalkylene carboxylic acid ester nonionic surfactants (B1-3) include esters of polyoxyalkylene mono- or polyols (such as polyoxyalkylene polyol, polyoxyalkylene monoalkyl ether, polyoxyalkylene monoaryl ether) and carboxylic acids (such as lower or higher fatty acids having carbon atoms of 2 to 22, polycarboxylic acids having carbon atoms of 2 to 40, aromatic carboxylic acids having carbon atoms of 7 to 25) such as unsaturated dibasic acid ester nonionic surfactants including polyoxyethylene (7) monooleate, polyoxyethylene (14) dioleate, diester of polyoxyethylene (7) tribenzylphenyl ether and maleic anhydride or maleic acid, polyoxyethylene (43) monooleate, polyoxyethylene (23) dioleate, diester of polyoxyethylene (15) dibenzylphenyl ether and maleic anhydride or maleic acid.

Polyoxyethylene-polyoxypropylene nonionic surfactants (B1-4) include oxyethylated compounds of polyoxypropylene polyol (such as polypropylene glycol, polyoxypropylene triol and polyoxypropylene alkylene diamine) such as pluronics nonionic surfactants including "Newpol PE61", "Newpol PE-68", "Newpol PE-71" and "Newpol PE-78" manufactured by Sanyo Chemical Industries, Ltd.

Alkylene oxide adducts of polyhydric alcohol fatty acid partial ester (B1-5) include esters of polyhydric alcohols (such as glycerol, trimethylolpropane, pentaerithritol, sorbitan, sorbitol and sucrose) and fatty acids having carbon atoms of 2 to 22 such as polyoxyethylene (9) glycerol monooleate, polyoxyethylene (6) sorbitan trioleate, polyoxyethylene (40) glycerol monooleate, polyoxyethylene (50) oxypropylene (3) soybean oil fatty acid ester of pentaerythritol, polyoxyethylene (40) sorbitan trioleate, polyoxyethylene (20) sorbitan monolaulate and polyoxyethylene (20) sorbitan monostearate.

Concrete examples of anionic surfactants (B2) include the following surfactants classified in (B2-1) to (B2-15).

Salts of higher fatty acid having 8 to 22 carbon atoms (B2-1) include sodium stearate, sodium palmitate and sodium oleate.

Salts of alkyl polyoxyalkylene alkyl carboxylic acid (B2-2) include sodium salt of tridecyl polyoxyethylene (3) acetic acid and sodium salt of lauryl polyoxyethylene (2) acetic acid.

Condensation products of higher fatty acid having 8 to 22 carbon atoms and amino acids having 2 to 11 carbon atoms (B2-3) include sodium salt of lauryl sarcosine and sodium salt of oleyl-α-aminopropionic acid.

Salts of higher alcohol sulfate having 8 to 22 carbon atoms (B2-4) include sodium salt of lauryl sulfate, sodium salt of cetyl sulfate and sodium salt of stearyl sulfate.

Salts of polyoxyalkylene higher alcohol ester sulfate (wherein the higher alcohol segment has 8 to 22 carbon atoms) (B2-5) include sodium salt of polyoxyethylene (3) lauryl sulfate and triethanol amine salts of polyoxyethylene (2) lauryl sulfate triethanol amine.

Salts of higher fatty acid ester sulfate having 9 to 44 carbon atoms (B2-6) include sodium salt of monolauryl glyceryl sulfate, sodium salt of monooleyl diethylene glycol sulfate and sodium salt of monocetyl glyceryl sulfate.

Salts of alkylol sulfate of higher fatty amide (wherein the higher fatty amide segment has 8 to 22 carbon atoms and the alkylol group has 1 to 22 carbon atoms) (B2-7) include sodium salt of ethylol lauryl amide sulfate and sodium salt of ethylol oleyl amide sulfate.

Salts of higher alkyl sulfonic acid having 8 to 22 carbon atoms (B2-8) include sodium salt of lauryl sulfonic acid and sodium salt of stearyl sulfonic acid.

Sulfonates of higher fatty acid ester having 8 to 22 carbon atoms (B2-9) include potassium decanoyl oxyethane sulfonate.

Salts of alkylated sulfonic acid of higher fatty acid amide (wherein the alkyl segment of the alkylated sulfonic acid has 1 to 22 carbon atoms and the higher fatty acid segment of the higher fatty acid has 8 to 22 carbon atoms) (B2-10) include sodium lauryl methyl tauride and sodium palmityl methyl tauride.

Salts of alkylester of sulfosuccinic acid having alkyl group of 8 to 22 carbon atoms (B2-11) include disodium lauryl sulfosuccinate, sodium dilauryl sulfosuccinate; and sodium dioctyl sulfosuccinate.

Salts of polyoxyalkylene alkyl ether sulfosuccinate (B2-12) include disodium salt of polyoxyalkylene lauryl ether sulfosuccinate and sodium salt of polyoxyalkylene (2) lauryl ether disulfosuccinate.

Salts of polyoxyalkylene alkaloyl alkanol amide sulfosuccinate (B2-13) include disodium salt of lauroyl monoethanol amide polyoxyethylene (3) monosulfosuccinate and disodium salt of lauroyl monoethanol amide polyoxyethylene (1) monosulfosuccinate.

Salts of higher alcohol phosphate having 8 to 22 carbon atoms (B2-14) include sodium salt of lauryl phosphate, potassium salt of tridecyl phosphate and sodium salt of oleyl phosphate.

Salts of polyoxy alkylene higher alcohol phosphate ester (wherein a higher alcohol segment has 8 to 22 carbon atoms) (B2-15) include sodium salt of polyoxyethylene (2) lauryl phosphate and triethanol amine polyoxyethylene (5) stearyl phosphate.

The above-mentioned examples of (B) may be used in a combination of two or more.

Among the examples of (B), preferable are at least one surfactant selected from the group consisting of (B1-1), (B1-2), (B1-5) and (B2-11).

Examples of a (C) solvent having a boiling point of 50 to 250° C. in the present invention include those disclosed in P.26–29 of "Solvent Handbook" published by Maki Shoten on Apr. 5, 1967 as the first edition.

Concrete examples include hydrocarbon solvents such as hexane, cyclohexane, toluene and xylene; chlorinated hydrocarbon solvents such as carbon tetrachloride, ethylene dichloride and chlorotoluene; alcohol solvents such as ethanol, isopropanol and benzylalcohol; polyhydric alcohol solvents such as ethylene glycol and diethylene glycol; ether solvents such as diisopropyl ether, phenyl ethyl ether, dioxane, cellosolve, butyl cellosolve, and Carbitol; aldehyde solvents such as furfural and benzaldehyde; ketone solvents such as acetone, methyl ethyl ketone and cyclohexanone; ester solvents such as ethyl acetate, butyl acetate and isopropyl acetate.

Among these examples, alcohol solvents, polyhydric alcohol solvents and ether solvents are preferable, and especially preferable is ethylene glycol of the polyhydric alcohol solvents group.

When a water-insoluble water-absorbent resin is used in the form of a solvent dispersion for treating the base material, the water-insoluble water-absorbing resin adheres to the base material with its each particle adhered independently to the base material. On the other hand, when a water-insoluble water-absorbent resin is used in the form of an aqueous dispersion for treating the base material, the water-insoluble water-absorbent resin forms gel, and therefore the particles of water-insoluble water-absorbent resin adhere to each other to form a continuous layer on the base material. Thus it is necessary to use a solvent (C). When printed by an ink-jet method or a textile printing method, the former provides a good ink-blurring prevention effect and a picture with a sharp outline, while the latter provides a poor ink-blurring prevention effect and a picture without a sharp outline.

Printing methods used in this invention include an ink-jet printing method and a textile printing method. The ink-jet printing method may be achieved by discharging the dye ink effectively from the nozzle, and applying the ink on the interior base material which is the object of the ink-jet printing. Typical examples are disclosed, for example, in I.E.E.E. Transactions on Industry Applications, Vol. 1A-13, No. 1; and Nikkei Electronics, Apr. 19, 1976 and Feb. 3, 1977.

Typical examples include the following methods (1) to (3).

(1) The electrostatic attraction system: a method which applies a ferroelectric field between a nozzle and an accelerating electrode disposed several millimeters apart and draws granulate ink out of the nozzle continuously; then when the drawn ink particles flow between deflecting electrodes, an information signal is given to the deflecting electrodes to be recorded.

(2) The ultrasonic vibration system: a method to apply high pressure to the ink by means of a small pump, with the nozzle vibrated mechanically by a quartz oscillator to jet out small ink particles and at that moment the jetted ink particles are electrically charged depending on the information signal, to be deflected depending on the amount of charge when passing through deflecting electrode plates.

(3) The piezoresistive element system: a method to utilize piezoresistive elements, that is, to provide the piezoresistive elements with electric signals to cause mechanical displacement, and apply pressure to jet out ink from the nozzle.

These various ink-jet systems are known arts and these systems can be applied to the invention optionally.

Dye inks used in an ink-jet printing method need to be an ink capable of dyeing an interior-base material. Examples of such dyes include acid dyes, direct dyes, reactive dyes, cationic dyes and disperse dyes.

Dyes comprising dye inks need to be chosen according to the fibrous material used in the base material so that the ink is dyeable. For example, when a polyester or acetate fiber is used as the fibrous material comprising the interior base material, the dye ink comprising a disperse dye is used.

When the interior base material comprises a material dyeable with an anionic dye such as wool, silk, polyamide, cotton or rayon, anionic dyes such as direct dye, acid dyes and reactive dyes are used. When a material dyeable with a cationic dye is used such as acrylic fiber or polyester fiber dyeable with a cationic dye, a cationic dyes are used.

Examples of conventional disperse dyes include azo disperse dyes, anthraquinone disperse dyes, nitrodiphenyl amine disperse dyes, naphthalimide disperse dyes, naphthoquinone imide disperse dyes, methyne disperse dyes. Concretely, disperse dyes disclosed in P.725–816 of "Dye Handbook New Edition" published by Maruzen can be used.

Examples of conventional direct dyes include azo direct dyes, stilbene direct dyes, thiazole direct dyes, dioxazine direct dyes and phthalocyanine dyes. Concretely, direct dyes disclosed in P.317–396 in the above-mentioned Dye Handbook can be used.

Examples of conventional acid dyes include azo acid dyes, anthraquinone acid dyes, triphenyl methane acid dyes and xanthine acid dyes. Concretely, acid dyes disclosed in P.393–526 in the above-mentioned Dye Handbook can be used.

Examples of conventional reactive dyes include azo reactive dyes, anthraquinone reactive dyes and phthalocyanine reactive dyes. Concretely, reactive dyes disclosed in P.881–934 in the above-mentioned Dye Handbook can be used.

Concrete examples of conventional cationic dyes include those disclosed in P.529–562 of the above-mentioned Dye Handbook.

Dye inks designed to suit various ink-jet methods can be used. However, in consideration of the environmental protection and the blurring prevention effect to the interior base material, water-based inks such as aqueous solutions of a dye and water disperse solutions of a dye are preferably used.

The inks can optionally include additives such as property adjusting additives including adjusting additives of viscosity, surface tension, electric conductivity and pH, antimold agents, disinfectants, chelating agents and ink-drying prevention agents. The ink-drying prevention agents prevent clogging up of the ink-jet-nozzle with an ink. Examples of such ink-dying prevention agents include polyhydric alcohols such as ethylene glycol and glycerol; N-alkyl pyrrolidones such as N-methyl pyrrolidone and N-ethyl pyrrolidone; ether compounds such as methyl cellosolve, ethyl cellosolve, methyl Carbitol; formamide derivatives such as N-cyclohexyl formamide, N-,N- dibutyl formamide; and aralkyl alcohols such as benzyl alcohol and 1-phenyl ethyl alcohol.

The preferable viscosity of a dye ink is 1 to 100 cps.

Conventional textile printing methods such as screen printing and a roller printing can be optionally used. Examples of textile printing methods are disclosed in P.153–270 of "Dip Dyeing - Textile Printing" published by Chijin Shokan on Nov. 30, 1967 as the first edition and P.38–272 of "Adjusting Method of Textile Printing Dye Paste" published by Sen'i Kenkyusha on Feb. 1, 1979 as the first edition.

(1) Screen Printing

Screen printing is a method of printing with a screen printing machine. A printing vehicle having a frame fixing device, a sliding device with a squeegee and a power unit for moving, moves electrically on rails attached to the sides of a printing table. The rails have stoppers to stop the printing vehicle in a fixed interval so that the frame comes down to allow squeegeeing for a certain times according to the thickness of the fabric. Then the frame is elevated and the printing vehicle start moving again. The above-mentioned procedure is conducted each time per one color and is repeated some times as necessary to complete the printing. Since such printing method is well-known, detailed explanation is not provided herein.

(2) Roller printing

Roller printing is a method of printing with a roller printing device (one-side type, duplex type or intermittent type). A textile printing paste is supplied to the dent portion of a engraved copper roll of the roller printing device to press-print the fabric. It is a kind of an intaglio printing. Since this printing method is well-known as well, detailed explanation is not provided herein.

These printing methods can be optionally adopted.

Textile printing dye pastes used in textile printing methods are a viscous composition comprising a paste dissolved in water and a dye dissolved therein. Examples of pastes include marine product pastes such as sodium alginate, carrageenan, chitin; starch pastes such as flour starch and British Gum; gum pastes such as gum arabic, locust bean gum and guar gum; cellulose pastes such as methyl cellulose and carboxymethyl cellulose; and synthetic pastes such as polyvinyl alcohol and acrylic acid copolymers.

Pastes can be optionally adopted according to the dye used, color development of the dye, and picture sharpness and can be used in a combination of two or more.

Dyes used in a textile printing dye paste need to be capable of dyeing interior base materials as the dyes used in an ink-jet method, and the aforementioned dyes can be used for a textile printing dye paste.

Textile printing dye pastes include not only a paste and a dye but also softening agents {sodium tertiary phosphate anhydride, tetrasodium pyrophosphate, polyphosphates such as sodium tripolyphosphate, EDTA (ethylene diamine tetra acetic acid), zeolite}, dye solvents such as thiodiethylene glycol and dimethyl formamide, antifoaming agents such as 2-ethylhexyl alcohol and silicone compounds, dyeing auxiliaries such as penetrating agents, leveling agents, retarding agents, and moisture retaining agents such as glycerol, urea and sodium pyrrolidone carboxylate.

Viscosity is an important factor in a textile printing dye paste used in textile printing methods in the present invention, and is generally from 100 to 10,000 cps, preferably from 300 to 8,000 cps, more preferably from 500 to 5,000 cps. If the viscosity is less than 100 cps, a picture with a sharp outline cannot be obtained in textile printing, and if it exceeds 10,000 cps, a dye cannot be homogeneously penetrated to the deep part of the interior base material.

Examples of interior base materials in the present invention include fabrics such as a woven fabric, a knitted fabric and a non-woven fabric; moquette fabrics such as a raised fabric and a flocked fabric; carpet base materials such as a woven carpet, a knitted carpet, a tufted carpet, a stitched-on-pile-carpet, a bonded-pile-carpet, a flocked carpet and a knotted-pile-carpet; and papers such as a machine-made paper and a Japanese paper.

As fiber materials for such fabrics or carpet base materials, any fiber materials including optional synthetic fibers such as polyester, polyamide and acrylic fiber, semi-synthetic fibers such as acetate and rayon, natural fibers such as cotton, silk and wool, and mixture thereof such as blended woven fabric and twisted union fabric (a fabric made of a thread obtained by twisting different kinds of spinned fibers to integrate) can be used.

Examples of the interior materials produced in a dyeing method of an interior base materials of this invention include ceiling material, wall material, floor material (including carpet), mural decoration, curtain, blind, lamp shade, seat material for trains or automobiles, and seat material for airplanes or vessels.

Next, methods of treating an interior base material with a treating agent comprising a water-insoluble water-absorbent resin (A), a polyoxyalkylene nonionic surfactant and/or an anionic surfactant (B) and a solvent having a boiling point of 50 to 250° C. (C) will be described. Any of the following three methods can be applied.

1) The method of initially treating with a dispersion of (A) in a solvent (C) followed by treating with a solution of (B) in a solvent (C).

2) The method of initially treating with a solution of (B) in a solvent (C) followed by treating with a dispersion of (A) in a solvent (C).

3) The method of preliminary dissolving (B) in a solvent (C) and then dispersing (A) therein, and treating with the mixture.

In consideration of rationalization and the performance of the operation such as a blurring prevention effect of a dye ink or a dye paste (sharpness of the picture outline) and homogeneous penetration effect of the ink to the deep part, the method 3) is preferable.

The method 3) will be described in further details. A surfactant (B) is dissolved in a solvent (C). The solvent concentration of solution of (B) in a solvent (C) is not particularly limited, but preferably is 1 to 30 weight %. And (A) is dispersed in the solution of (B) in a solvent (C) to prepare the dispersion. The dispersion concentration of (A) in a solvent (C) is not particularly limited, but preferably is 1 to 30 weight %. The interior base material is treated with the prepared mixed dispersion by any of the padding method, spray method, coating method and printing method, and if necessary followed by a drying operation. Among these methods, the spray method is preferable. If an explosion-proof drier is used in the drying operation, alcohol solvents such as methanol and isopropanol, or hydrocarbon solvents such as toluene and xylene which easily evaporate can be used as a solvent (C) preferably. If a drier used in the drying operation is not an explosion-proof drier, polyhydric alcohols such as ethylene glycol can be used as a solvent (C) preferably.

The pickup amount of the solid of (A) and (B) is preferably 0.01 to 30 weight % respectively to the interior base material before treatment. The above mentioned range of a pickup amount of the solid of (A) is preferable since it prevents problems such as deterioration of the blurring prevention effect (sharpness of the picture outline) of the dye ink or dye paste, or hardening of the feeling. The above mentioned range of a pickup amount of the solid of (B) is preferable since it allows the homogeneous penetration of the dye ink or the textile printing dye paste to the deep part of the interior base material, and sufficient blurring prevention effect of (A) to the dye ink or the textile printing dye paste.

The weight ratio of (A) and (B) is preferably from (300:1) to (300:300), more preferably from (300:3) to (300:200). If the ratio of (B) is too small and (A) is too much, although the blurring prevention effect of the dye ink or the textile printing dye paste is excellent, the homogeneous penetration effect to the deep part of the base material tends to deteriorate. On the other hand, if the ratio of (A) is too small and (B) is too much, although the homogeneous penetration effect to the deep part of the base material can be achieved, the blurring prevention effect of (A) tends to be insufficient. Therefore the above-mentioned ratio is preferable since it prevents these problems.

Concrete examples of printing in an ink-jet method or a textile printing method in the present invention will be described. An interior base material to be printed is prepared by treating an interior base material by spraying with a treating agent comprising a water-insoluble water-absorbent resin (A), a polyoxyalkylene nonionic surfactant and/or an anionic surfactant (B), and a solvent having a boiling point of 50 to 250° C. (C), and optionally followed by drying. The treated interior base material is printed by jetting out a dye ink with an ink-jet printer, or by printing a textile printing dye paste, followed by a steaming or dry-heating for color development of the dye applied to the interior base material. The conditions of the color development by heating vary depending upon the kind of the dye and the kind of the base material to be printed, but in general, it is preferable to have a steaming treatment at 100 to 130° C. for 10 to 30 minutes, or to have a dry-heating treatment at 180 to 210° C. for 1 to 5 minutes. Finally, to remove the unfixed dye, water-insoluble water-absorbent resin and a polyoxyalkylene nonionic surfactant and/or an anionic surfactant, soaping or reduction cleaning is conducted, and optionally followed by a finishing treatment such as water-repelling treatment, soil resistant finishing, flame retardent treatment and mildew proof finishing.

Although the present invention will be further described referring to Examples, the present invention is not limited to them. Hereinafter "percent" refers to weight percent, "part" refers to weight part respectively, and performance is evaluated as follows.

1. Sharpness Examination

Geometrical patterns were printed by the ink-jet method or the textile printing method to evaluate the sharpness with the naked eye. The printed geometrical patterns were a solid isosceles triangle having angles of 20°, 80°, 80° and a base 3 cm in length, and a square with sides 3 cm in length having a slit of 1 mm width at the center thereof.

(Criteria of the evaluation)

◎: Printed without any blurring, having sharp fine lines of the patterns.

○: Printed without blurring, having sharp fine lines of the patterns.

Δ: Printed with slight blurring, having unclear fine lines of the patterns.

X: Printed with blurring, having fine lines of patterns not expressed at all.

2. Penetration Examination

The solid printing was conducted by the ink-jet method or the textile printing method and the drying operation followed, then the lightness (L value) of the printed surface (a) and the inner part revealed by cutting the pile by 2 mm thickness (b) was measured with "Multi Spectro MSC-2" manufactured by Suga Shikenki Co., Ltd. and the color difference (ΔE) between (a) and (b) at the center part was calculated.

A smaller value of a color difference (ΔE) means the point has a similar lightness to (a), and thus the printing is conducted successfully having the dye ink penetrated well to the deep part.

3. Build-up Examination

The average value of the lightness (L value) of the printed object surface (a) in the item 2. measured at 5 points was calculated. A smaller value represents a good build-up. The build-up refers to the quantity rate of dye-deposition in the printing process; that is, a degree of dye exhaustion.

EXAMPLE 1

To a nylon carpet base material of 800 g weight per square meter having 5 mm pile length, 24.8 g weight per square meter, namely, 3.1% with respect to the base material based on pickup amount of the solid contents of the below-mentioned composition was sprayed, followed by drying at 80° C. for 5 minutes to obtain an interior base material for dye ink printing of the present invention.

| | |
|---|---|
| "SANWET IM-1000SP" [starch series crosslinked-type water-insoluble water-absorbent resin manufactured by Sanyo Chemical Industries, Ltd., with water absorbency to pure water of 900 ml/g, average particle size of 15 μm] | 30 (parts) |
| "Nonipolsoft SS-70" [nonionic surfactant manufactured by Sanyo Chemical Industries, Ltd.] | 0.3 (part) |
| Ethylene glycol | remainder |
| Total | 100 (parts) |

The above-described base material was printed by the ink-jet printing under the following conditions.

| (Composition of the ink for ink-jet process) | |
|---|---|
| "SUMINOL MILLING RS" [Acid dye manufactured by Sumitomo Chemical Company, Limited] | 5 (parts) |
| N-methyl pyrrolidone | 10 (parts) |
| Ethylene glycol | 15 (parts) |
| Deionized water | 70 (parts) |
| Total | 100 (parts) |

(Property of the ink)
viscosity (cps/25° C.): 10
surface tension (dyne/cm, 25° C.): 56.3
pH: 8
(Ink-jet printing)
(1) Printing
1) Ink-jet process: ink on demand system
2) Nozzle diameter: 60 μm
3) Applied voltage: 50 V
(2) Drying: at 80° C., for 5 minutes

EXAMPLE 2

"Nonipolsoft SS-70" of Example 1 was replaced with "Ionet DO-600" [nonionic surfactant, manufactured by Sanyo Chemical Industries, Ltd.] and a treated interior base material for dye ink printing of the present invention was produced by the same way as in Example 1. Ink-jet printing was conducted in the same way as in Example 1.

EXAMPLE 3

"Nonipolsoft SS-70" of Example 1 was replaced with "Carabon DA-72" [sodium salt of dioctyl sulfosuccinate manufactured by Sanyo Chemical Industried, Ltd.] and a treated interior base material for dye ink printing of the present invention was produced by the same way as in Example 1. Ink-jet printing was conducted in the same way as in Example 1.

Comparative Example 1

Only with the water-insoluble water-absorbent resin in Example 1, namely without using "Nonipolsoft SS-70", an interior base material for dye ink printing was produced in the same way as Example 1. Further, ink-jet printing was conducted in the same way as in Example 1.

The printed interior base materials of Examples 1–3 and Comparative Example 1 were evaluated in terms of sharpness, penetration, and build-up, and the results are described in Table 1.

TABLE 1

| | Sharpness | Penetration color difference (ΔE) | Build-up (L value) |
|---|---|---|---|
| Example 1 | ⊙ | 0.4 | 19.6 |
| Example 2 | ⊙ | 0.4 | 20.3 |
| Example 3 | ⊙ | 0.3 | 18.9 |
| Comparative Example 1 | ⊙ | 1.5 | 23.6 |

The evaluation results described in Table 1 illustrate good performance of the objects printed by the ink-jet printing of the present invention, that is, excellent sharpness, uniform penetration of the ink to the deep parts to dye the inner part of the base material, illustrating excellent penetration. They also displayed excellent build-up.

EXAMPLE 4

To a polyester moquette of 500 g weight per square meter having 4 mm pile length, 25 g weight per square meter, namely, 5% with respect to the base material based on pickup amount of the solid contents of the below-mentioned composition was sprayed, followed by passing between rubber covered rolls with a pressure of 0.6 Kg/cm$^2$, and drying at 95° C. for 10 minutes to obtain a treated interior base material for dye ink printing of the present invention.

| | |
|---|---|
| "SANWET IM-5000MPS" [polyacrylic acid (salt) water-insoluble water-absorbent resin manufactured by Sanyo Chemical Industries, Ltd., with water absorbency to pure water for 400 ml/g, having average particle size of 30 μm] | 25 (parts) |
| "Carabon DA-72" [sodium salt of dioctyl sulfosuccinate manufactured by Sanyo Chemical Industries, Ltd.] | 0.3 (part) |
| Ethylene glycol | remainder |
| Total | 100 (parts) |

The above-mentioned base material was printed by textile printing method with the following conditions.

| (Composition of the textile printing dye paste) | |
|---|---|
| "Kayaron Polyester Red Violet RSF" | 1 (part) |
| "Kayaron Polyester Red Violet Pink BF" | 1 (part) |
| Stock paste* | 70 (parts) |
| Acetic acid (90%) | 1 (part) |
| Hot water | remainder |
| Total | 100 (parts) |

*Stock paste has the composition by weight ratio of processed starch (8% aqueous solution)/locust bean gum (6% aqueous solution)/carboxy methyl cellulose (CMC) (4% aqueous solution): 1/1/1.

viscosity (cps/25° C.): 2500
pH: 5.5
(Textile printing)
(1) Printing
Screen printing
(2) Color developing treatment
Steaming treatment: at 130° C., for 30 minutes
(3) Reduction cleaning
Hydrosulfite 1 g/L
Sodium hydroxide 1 g/L Washing with water at 90° C., for 10 minutes.

(4) Drying at 85° C., for 5 minutes

EXAMPLE 5

"Carabon DA-72" of Example 4 was replaced with "Newpol PE-61" [Pluronic nonionic surfactant manufactured by Sanyo Chemical Industries, Ltd.] and a treated interior base material for dye ink printing of the present invention was produced in the same way as in Example 4. Textile printing was conducted in the same way as in Example 4.

EXAMPLE 6

"Carabon DA-72" of Example 4 was replaced with "Nonipol 70" [nonionic surfactant manufactured by Sanyo Chemical Industries, Ltd.] and a treated interior base material for dye ink printing of the present invention was produced in the same way as in Example 4. Textile printing was conducted in the same way as in Example 4.

Comparative Example 2

Only with the water-insoluble water-absorbent resin in Example 4, namely without using "Carabon DA-72", a treated interior base material for dye ink printing was produced in the same way as Example 4. Further, textile printing was conducted in the same way as in Example 4.

The printed interior base materials of Examples 4–6 and Comparative Example 2 were evaluated in terms of sharpness, penetration, and build-up, and the results are described in Table 2.

TABLE 2

| | Sharpness | Penetration color difference (ΔE) | Build-up (L value) |
|---|---|---|---|
| Example 4 | ⊙ | 0.9 | 26.3 |
| Example 5 | ⊙ | 0.7 | 25.5 |
| Example 6 | ⊙ | 0.8 | 24.3 |
| Comparative Example 2 | ⊙ | 2.3 | 35.6 |

The evaluation results described in Table 2 illustrate good performance of the objects printed by the textile printing of the present invention, that is, excellent sharpness, uniform penetration of the ink to the deep parts to dye the inner part of the moquette, illustrating excellent penetration. They also displayed excellent build-up.

The present invention provides a valuable printed object with excellent penetration effect enabling uniform printing from the surface to the deep part of the base material even to a base material having a three-dimensional structure such as unevenness or a base material having a long pile and thickness such as moquette with the ink-jet method or textile printing method. It also provides an excellent build-up.

The disclosures of all of the publications mentioned above are incorporated herein by reference.

What is claimed is:

1. A material selected from the group consisting of fabric and carpet substrate, obtained by a method comprising the step of treating a surface of said material with a treating agent which consists essentially of (A) a water-insoluble water-absorbent resin having a water absorbency for pure water of 50 to 1.000 ml/g and a particle size of 0.1 to 100 μm, (B) at least one surfactant selected from the group consisting of (1) a polyoxyalkylene nonionic surfactant and (2) an anionic surfactant, and (C) a solvent having a boiling point of 50 to 250° C.

2. The material according to claim 1, wherein (C) is ethylene glycol.

3. The material according to claim 1, wherein the amount of each of (A) and (B) with respect to the untreated material is 0.01 to 30 weight percent.

4. The material according to claim 1, wherein the weight ratio of (A) and (B) is in the range of (300:1) to (300:300).

5. The material of claim 1, wherein (A) is selected from the group consisting of partially hydrolyzed products of crosslinked polyacrylamide, crosslinked copolymers of acrylic acid-acrylamide, crosslinked polyacrylic acid salts, crosslinked copolymers of acrylic acid-acrylic acid ester, crosslinked copolymers of isobutylene-maleic acid anhydride and crosslinked carboxylic acid modified polyvinyl alcohol.

6. The material according to claim 1, wherein (B) is selected from the group consisting of polyoxyalkylene alkyl ether nonionic surfactants, polyoxyalkylene aryl ether nonionic surfactants, alkylene oxide adducts of polyhydric alcohol fatty acids partial ester and salts of alkyl ester of sulfosuccinic acid.

7. The material according to claim 1, wherein (C) is selected from the group consisting of alcohols, polyhydric alcohols and ethers.

8. A material selected from the group consisting of ceiling material, wall material, floor material, mural decoration, curtain material, blind material, lamp shade, and seat material for trains, automobiles or airplanes, obtained by a method comprising a step of treating a surface of said material with a treating agent which consists essentially of (A) a water-insoluble water-absorbent resin having a water absorbency for pure water of 50–1,000 ml/g and a particle size of 0.1 to 100 μm, (B) at least one surfactant selected from the group consisting of (1) a polyoxyethylene nonionic surfactant and (2) an anionic surfactant, and (C) a solvent having a boiling point of 50 to 250° C.

9. The material, according to claim 8, wherein (C) is ethylene glycol.

10. The material according to claim 8, wherein the amount of each of (A) and (B) with respect to the untreated material is 0.01 to 30 weight percent.

11. The material, according to claim 8, wherein the weight ratio of (A) and (B) is in the range of (300:1) to (300:300).

12. The material of claim 8, wherein (A) is selected from the group consisting of partially hydrolyzed products of crosslinked polyacrylamide, crosslinked copolymers of acrylic acid-acrylamide, crosslinked polyacrylic acid salts, crosslinked copolymers of acrylic acid-acrylic acid ester, crosslinked copolymers of isobutylene-maleic acid anhydride and crosslinked carboxylic acid modified polyvinyl alcohol.

13. The material according to claim 8, wherein (B) is selected from the group consisting of polyoxyalkylene alkyl ether nonionic surfactants, polyoxyalkylene aryl ether nonionic surfactants, alkylene oxide adducts of polyhydric alcohols fatty acids partial ester and salts of alkyl ester of sulfosuccinic acid.

14. The material according to claim 8, wherein (C) is selected from the group consisting of alcohols, polyhydric alcohols and ethers.

* * * * *